US010218088B2

(12) United States Patent
Chang

(10) Patent No.: US 10,218,088 B2
(45) Date of Patent: Feb. 26, 2019

(54) CABLE CONNECTOR ASSEMBLY

(71) Applicant: LOTES CO., LTD, Keelung (TW)

(72) Inventor: Wen Chang Chang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/866,819

(22) Filed: Jan. 10, 2018

(65) Prior Publication Data

US 2018/0212338 A1 Jul. 26, 2018

(30) Foreign Application Priority Data

Jan. 24, 2017 (CN) ..... 2017 2 0094000 U

(51) Int. Cl.

| | |
|---|---|
| ***H01R 4/02*** | (2006.01) |
| ***H01R 12/52*** | (2011.01) |
| ***H01R 12/58*** | (2011.01) |
| ***H01R 13/652*** | (2006.01) |
| ***H01R 13/6583*** | (2011.01) |
| ***H01R 13/6586*** | (2011.01) |
| *H01R 13/6471* | (2011.01) |
| *H01R 12/71* | (2011.01) |

(Continued)

(52) U.S. Cl.

CPC ..... *H01R 4/023* (2013.01); *H01R 12/52* (2013.01); *H01R 12/58* (2013.01); *H01R 13/6583* (2013.01); *H01R 13/6586* (2013.01); *H01R 4/027* (2013.01); *H01R 12/716* (2013.01); *H01R 13/502* (2013.01); *H01R 13/6471* (2013.01); *H01R 13/652* (2013.01); *H01R 13/6594* (2013.01); *H01R 24/60* (2013.01); *H01R 2107/00* (2013.01)

(58) Field of Classification Search

CPC ..... H01R 4/023; H01R 12/52; H01R 12/58; H01R 12/716; H01R 13/6583; H01R 13/6586

See application file for complete search history.

(56) References Cited

U.S. PATENT DOCUMENTS 9,577,385 B1 * 2/2017 Lin ..... H01R 13/6585
2015/0318646 A1 * 11/2015 Little ..... H01R 4/023 439/78

(Continued)

FOREIGN PATENT DOCUMENTS

| | | |
|---|---|---|
| CN | 204011984 U | 12/2014 |
| CN | 205565175 U | 9/2016 |
| CN | 105990761 A | 10/2016 |

*Primary Examiner* — Briggitte R Hammond
(74) *Attorney, Agent, or Firm* — Locke Lord LLP; Tim Tingkang Xia, Esq.

(57) ABSTRACT

A cable connector assembly includes an insulating body, a first terminal group and a second terminal group received in the insulating body and arranged into an upper row and a lower row, a shielding sheet fixed in the insulating body and located between the first terminal group and the second terminal group, and a cable having a ground core wire. The first terminal group includes a first ground terminal, and the first ground terminal has a first soldering portion. The second terminal group includes a second ground terminal, and the second ground terminal has a second soldering portion. The ground core wire is located between the first soldering portion and the second soldering portion and is in electrical contact with the first soldering portion, the second soldering portion and the shielding sheet.

16 Claims, 9 Drawing Sheets

(51) Int. Cl.

| | |
|---|---|
| *H01R 24/60* | (2011.01) |
| *H01R 107/00* | (2006.01) |
| *H01R 13/6594* | (2011.01) |
| *H01R 13/502* | (2006.01) |

(56) References Cited

U.S. PATENT DOCUMENTS

| | | | | |
|---|---|---|---|---|
| 2018/0166825 | A1* | 6/2018 | Ju | H01R 13/6275 |
| 2018/0212337 | A1* | 7/2018 | Chang | H01R 13/6586 |
| 2018/0212338 | A1* | 7/2018 | Chang | H01R 13/6586 |

* cited by examiner

CABLE CONNECTOR ASSEMBLY

CROSS-REFERENCE TO RELATED APPLICATION

This non-provisional application claims priority to and benefit of, under 35 U.S.C. § 119(a), Patent Application No. 201720094000.1 filed in P.R. China on Jan. 24, 2017, the entire content of which is hereby incorporated by reference.

FIELD OF THE INVENTION

The present invention relates to a cable connector assembly, and more particularly to a cable connector assembly in which terminals are soldered directly to a cable.

BACKGROUND OF THE INVENTION

An existing cable connector assembly includes an insulating body, multiple signal terminals and multiple ground terminals arranged in the insulating body, a middle shielding sheet arranged in the insulating body, and a cable having multiple core wires and multiple ground core wires. The signal terminals are soldered correspondingly to the signal core wires, the ground terminals are soldered correspondingly to the ground core wires, and the middle shielding sheet is in contact with the ground terminals with a ground connection. However, since the number of the signal terminals and ground terminals is large, a large number of signal core wires and ground core wires are needed to be soldered correspondingly. As a result, not only is the manufacturing cost increased, but also the manufacturing process is complex. In addition, since the middle shielding sheet is only in contact with the ground terminals for grounding, the phenomenon of poor contact can easily take place, and then a poor grounding effect is caused.

Therefore, a heretofore unaddressed need exists in the art to address the aforementioned deficiencies and inadequacies.

SUMMARY OF THE INVENTION

In one aspect, the present invention relates to a cable connector assembly in which ground core wires are located between first soldering portions and second soldering portions and are in electrical contact with the first soldering portions, the second soldering portions and a shielding sheet in order to reduce the manufacturing cost and simplify the manufacturing process.

In certain embodiments, a cable connector assembly includes an insulating body, a first terminal group and a second terminal group, a shielding sheet, and a cable. The first terminal group and the second terminal group are received in the insulating body and arranged into an upper row and a lower row. The first terminal group includes at least one first ground terminal, and the first ground terminal has a first soldering portion. The second terminal group includes at least one second ground terminal, and the second ground terminal has a second soldering portion. The second soldering portion and the first soldering portion are arranged oppositely. The shielding sheet is fixed in the insulating body, and located between the first terminal group and the second terminal group. The cable has at least one ground core wire. The ground core wire is located between the first soldering portion and the second soldering portion and is in electrical contact with the first soldering portion, the second soldering portion and the shielding sheet.

In certain embodiments, the shielding sheet is provided with a plate surface and a plate edge perpendicular to the plate surface, and the ground core wire is soldered to the plate edge.

In certain embodiments, the second ground terminal and the first ground terminal are aligned with each other in the vertical direction, the second ground terminal and the first ground terminal are soldered respectively to the upper surface and lower surface of the ground core wire, and the plate edge of the shielding sheet is soldered to the side surface of the ground core wire.

In certain embodiments, a gap exists between each of the first soldering portion and the second soldering portion and the plate edge in the horizontal direction, and the ground core wires partially extends into the gap so as to be soldered to the plate edge.

In certain embodiments, the shielding sheet is provided with a base fixed in the insulating body, an extension portion extends backward from the base, at least one yield slot is recessed forward from the rear end edge of the extension portion, the first terminal group includes at least one first power terminal, a third soldering portion extends from the first power terminal to enter and above the yield slot, the second terminal group includes at least one second power terminal, a fourth soldering portion extends from the second power terminal to enter and below the yield slot, the cable has at least one power core wire, and the power core wire is located in the yield slot and is in electrical contact with the third soldering portion and the fourth soldering portion.

In certain embodiments, the width of the yield slot is greater than the width of the third soldering portion and the width of the fourth soldering portion.

In certain embodiments, the first terminal group and an upper insulating block are insert-molded as a whole, the second terminal group and a lower insulating block are insert-molded as a whole, the rear end of the insulating body recessed forward with a receiving cavity, the upper insulating block and the lower insulating block jointly clamp the shielding sheet and are mounted in the receiving cavity, and a placement platform which protrudes out of the rear end of the receiving cavity is formed. The cable includes two rows of signal core wires which are arranged respectively on the upper surface and lower surface of the placement platform. The first terminal group is provided with multiple first signal terminals that are located on the upper surface of the placement platform so as to be soldered to the signal core wires of the upper row. The second terminal group is provided with multiple second signal terminals that are located on the lower surface of the placement platform so as to be soldered to the signal core wires of the lower row. The first ground core wire is located on the outer side of the placement platform so as to be soldered to the first ground terminal and the second ground terminal.

In certain embodiments, the front end of the first ground terminal is provided with a first contact portion that forwardly protrudes out of the upper insulating block, a first deflecting portion is deflected and extends from the first contact portion in a direction away from one side of the first signal terminals, a first bending portion is bent downwardly and extends from the first deflecting portion, and the first soldering portion is formed by horizontally extending backward from the first bending portion and located outside of the placement platform.

In certain embodiments, the upper surface and lower surface of the placement platform are provided respectively with at least one slot corresponding to the yield slot, and the third soldering portion and the fourth soldering portion are located correspondingly in the slots so as to be soldered to the power core wire.

In certain embodiments, the front end of the insulating body is recessed backward with an insertion cavity, a pair of latch arms respectively extends forward from both sides of the base to enter the insertion cavity, multiple terminal slots are recessed respectively from the top surface and bottom surface of the insulating body, the terminal slots communicate with the insertion cavity, the first terminal group and the second terminal group are received in the insertion cavity and respectively extend respectively into the terminal slots of the top surface and bottom surface of the insulating body, the first terminal group is provided with two first ground terminals on the outermost sides, and the second terminal group is provided with two second ground terminals on the outermost sides.

In certain embodiments, each of the first terminal group and the second terminal group is provided with twelve terminals, and the first terminal group and the second terminal group are arranged in mutual point symmetry with the central point of the insertion cavity as a center of symmetry.

In certain embodiments, the shielding sheet is provided with a flat plate shaped plate surface and a plate edge perpendicular to the plate surface, at least one ground portion is bent and extends from the plate surface to protrude out of the insulating body, and the at least one ground portion is in electrical contact with the side surface of the ground core wire.

In certain embodiments, the plate surface is provided with at least one connecting portion which extends transversely, the ground portion is formed by being bent and extending from the connecting portion along the vertical direction, and the plate edge is recessed transversely with two notches which are respectively located on two opposite sides of the connecting portion.

In certain embodiments, the first terminal group is provided with two first ground terminals on the outermost sides, the second terminal group is provided with two second ground terminals on the outermost sides, the cable is provided with two ground core wires which are soldered correspondingly to the two first ground terminals and the two second ground terminals, and two ground portions are formed by being bent respectively from both sides of the plate surface so as to be soldered correspondingly to the side surfaces of the two ground core wires.

In certain embodiments, the first terminal group and an upper insulating block are insert-molded as a whole, the second terminal group and a lower insulating block are insert-molded as a whole, the rear end of the insulating body is provided with a forward receiving cavity, the upper insulating block and the lower insulating block jointly clamp the shielding sheet and are mounted in the receiving cavity, the plate surface is provided with two ground portions, one of the ground portions is formed by being bent upwardly and extending from one side of the plate surface to block the side of the upper insulating block, and the other of the ground portions is formed by being bent downwardly and extending from the other side of the plate surface to block the side of the lower insulating block.

In certain embodiments, the extension portion is provided with a plate surface and a plate edge perpendicular to the plate surface, the plate edge is rougher than the plate surface, and the ground core wire is soldered to the plate edge.

Compared with the related art, certain embodiments of the present invention have the following beneficial advantages: the first ground terminal is provided with the first soldering portion, the second ground terminal is provided with the second soldering portion, the second soldering portion and the first soldering portion are arranged oppositely, the shielding sheet is located between the first terminal group and the second terminal group, the cable is provided with the ground core wire which is located between the first soldering portion and the second soldering portion and is in electrical contact with the first soldering portion, the second soldering portion and the shielding sheet, so that the first ground terminal, the second ground terminal and the shielding sheet share one core wire, consequently, the number of the ground core wires is reduced, and thereby, not only is the manufacturing cost reduced, but also the manufacturing process is simplified. In addition, since the shielding sheet is in electrical contact with the ground core wire, the phenomenon of poor contact is prevented, and thereby the shielding sheet has a good grounding effect.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
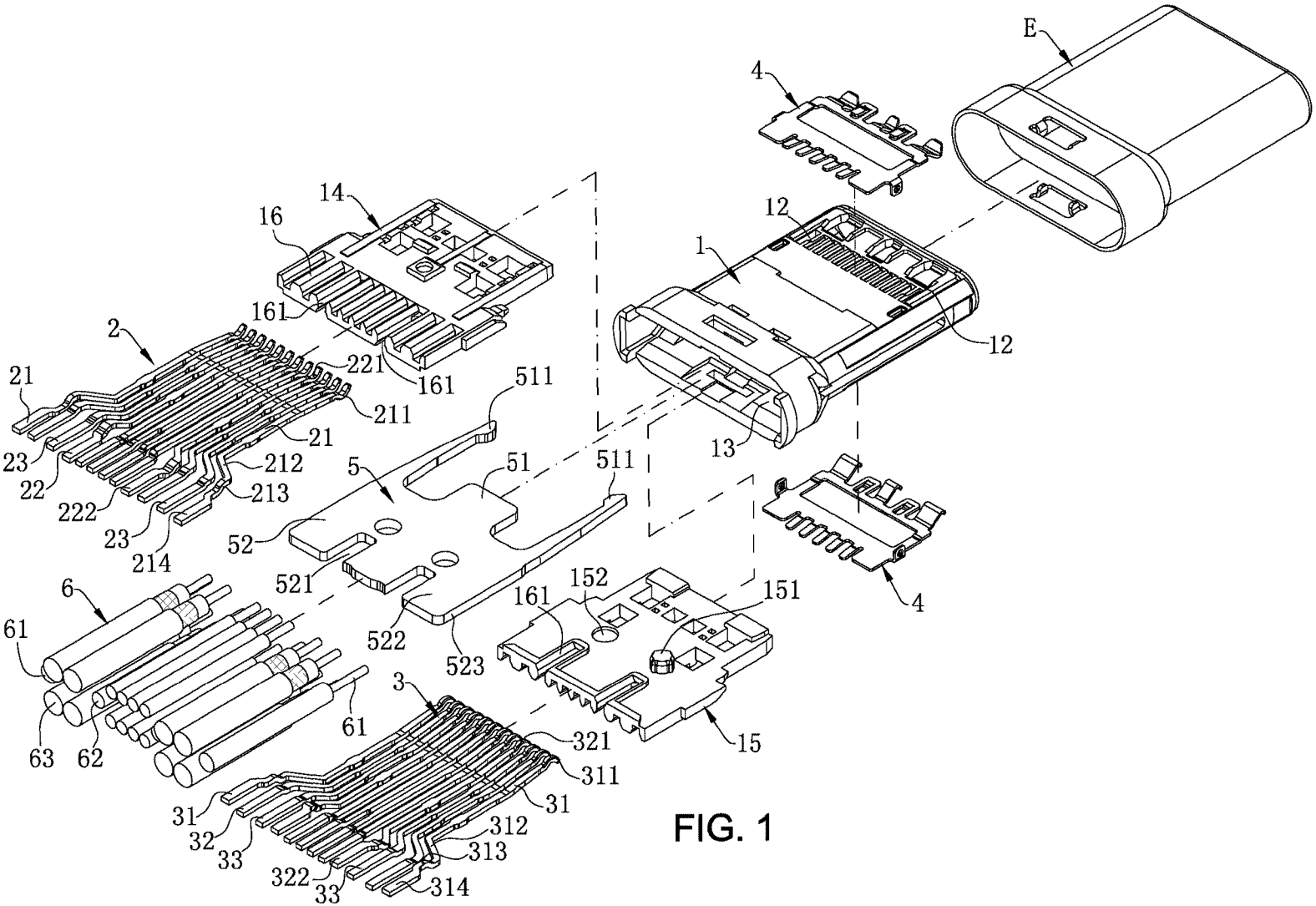
FIG. 1 is a schematic three-dimensional exploded view of a cable connector assembly according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to an electrical connector assembly.

Figure 2:
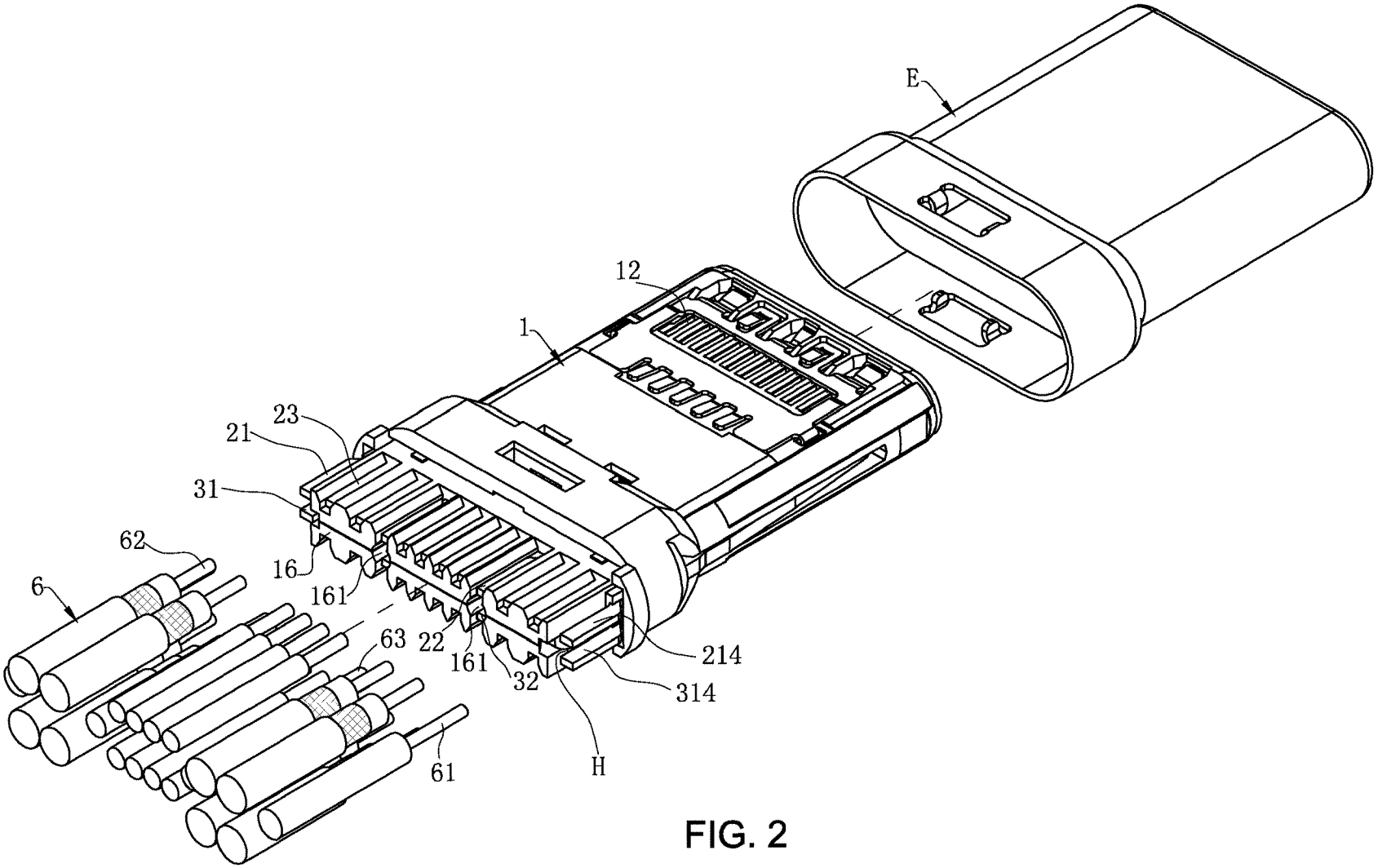
FIG. 2 is a partial assembly view of a cable connector assembly according to one embodiment of the present invention.
Figure 4:
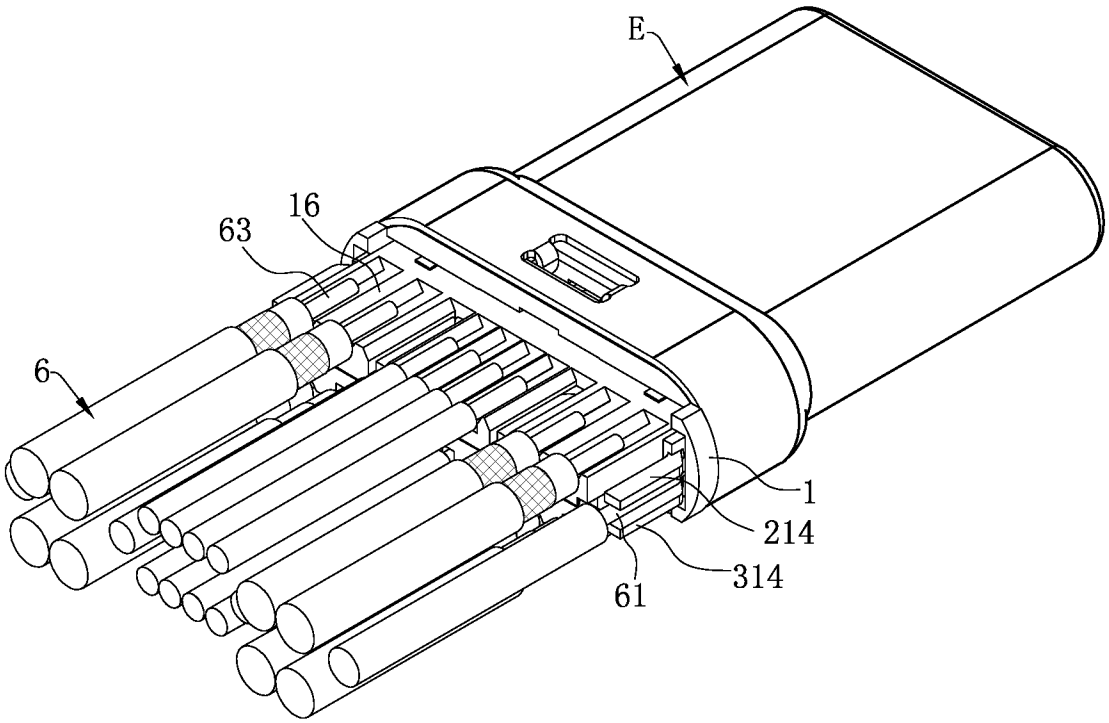
FIG. 4 is a schematic three-dimensional assembly view of a cable connector assembly according to one embodiment of the present invention.

As shown in FIGS. 1, 2 and 4, a cable connector assembly according to one embodiment of the present invention includes an insulating body 1, a first terminal group 2 and a second terminal group 3 received in the insulating body 1 and respectively arranged into an upper row and a lower row, a shielding sheet 5 fixed in the insulating body 1 and located between the first terminal group 2 and the second terminal group 3, a cable 6 configured to be soldered to the first terminal group 2 and the second terminal group 3, and a shielding shell E wrapping and fixed at the periphery of the insulating body 1.

Figure 5:
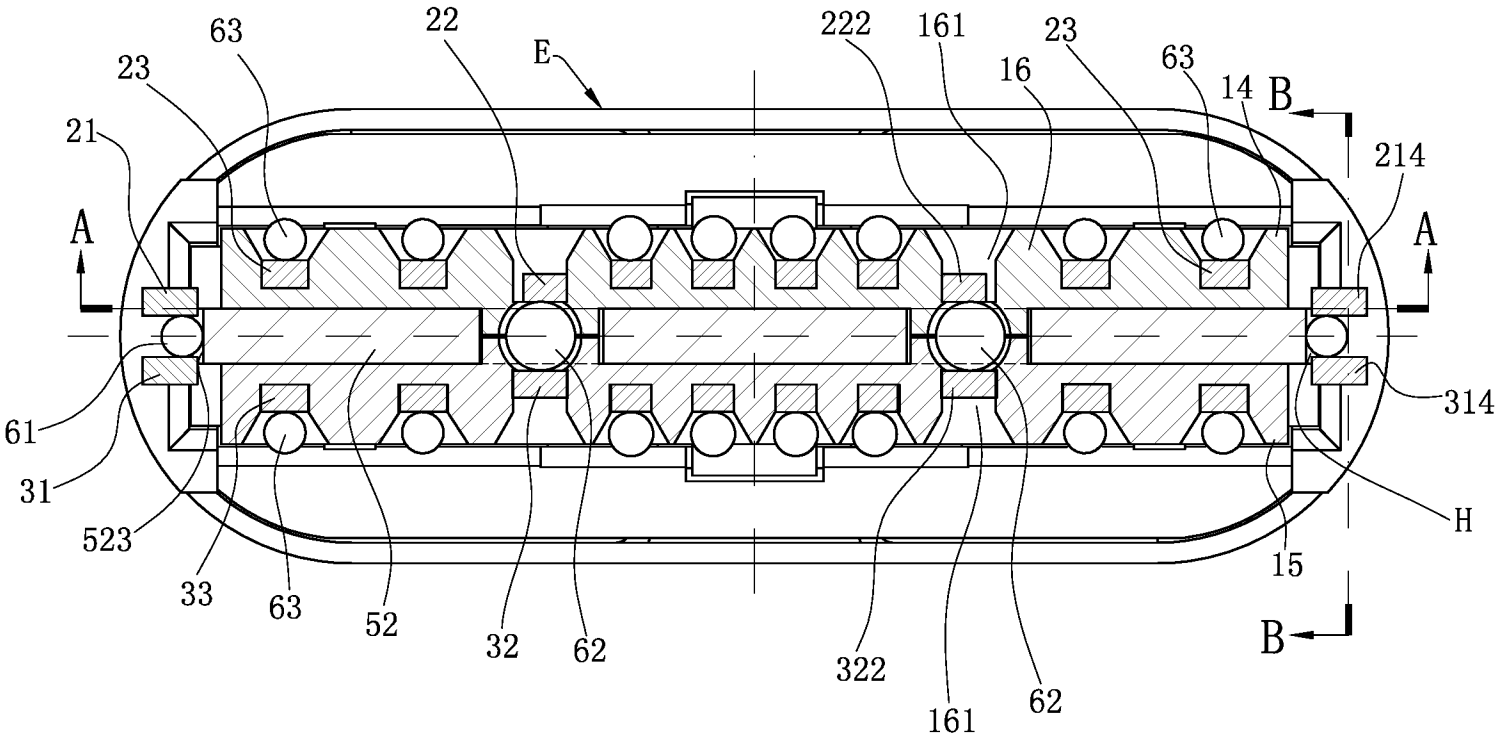
FIG. 5 is a sectional view of a cable connector assembly according to one embodiment of the present invention.

As shown in FIGS. 1, 2 and 5, the front end of the insulating body 1 is recessed forward to form an insertion cavity 11. The insertion cavity 11 is configured to receive a tongue (not shown) of a corresponding receptacle connector. Multiple terminal slots 12 are recessed respectively from the top surface and bottom surface of the insulating body 1, the terminal slots 12 communicate with the insertion cavity 11, and the first terminal group 2 and the second terminal group 3 are received correspondingly in the terminal slots 12 of the top surface and bottom surface of the insulating body 1 and extend into the insertion cavity 11. A pair of metal members 4 is mounted respectively on the top surface and bottom surface of the insulating body 1. The metal members 4 are located at the front sides of the terminal slots 12, and each metal member 4 is provided with multiple elastic pieces which extend into the insertion cavity 11.

As shown in FIGS. 1, 2 and 5, an upper insulating block 14 and a lower insulating block 15 are also arranged in the insulating body 1. The first terminal group 2 and the upper insulating block 14 are insert-molded as a whole, and the second terminal group 3 and the lower insulating block 15 are insert-molded as a whole. Each of the upper insulating block 14 and the lower insulating block 15 is provided with a fixing post 151 and a fixing hole 152, the fixing post 151 of the upper insulating block 14 is fitted fixedly in the fixing hole 152 of the lower insulating block 15, and the fixing post 151 of the lower insulating block 15 is fitted fixedly in the fixing hole 152 of the upper insulating block 14. The rear end of the insulating body 1 is recessed forward with a receiving cavity 13. The upper insulating block 14 and the lower insulating block 15 jointly clamp the shielding sheet 5 and are inserted into the receiving cavity 13 from the rear to the front. Moreover, a placement platform 16 which protrudes out of the rear end of the receiving cavity 13 is formed. The upper surface of the upper insulating block 14 is the upper surface of the placement platform 16, and the lower surface of the lower insulating block 15 is the lower surface of the placement platform 16. The placement platform 16 protrudes out of the receiving cavity 13, the first terminal group 2 and the second terminal group 3 extend to the placement platform 16, and the placement platform 16 is configured for the placement of the cable 6. The cable 6 has two rows of signal core wires 63 which are arranged respectively on the upper surface and lower surface of the placement platform 16 in order to be soldered correspondingly to the first terminal group 2 and the second terminal group 3. At least one slot 161 runs through each of the upper surface and lower surface of the placement platform 16 along the vertical direction. In the present embodiment, the upper surface and lower surface of the placement platform 16 are provided respectively with two slots 161, and the two slots 161 are arranged separately, and respectively run through the upper insulating block 14 and the lower insulating block 15 along the vertical direction. In the other embodiments, the placement platform 16 can also be provided with only one slot 161 for the placement of the cable 6.

Figure 3:
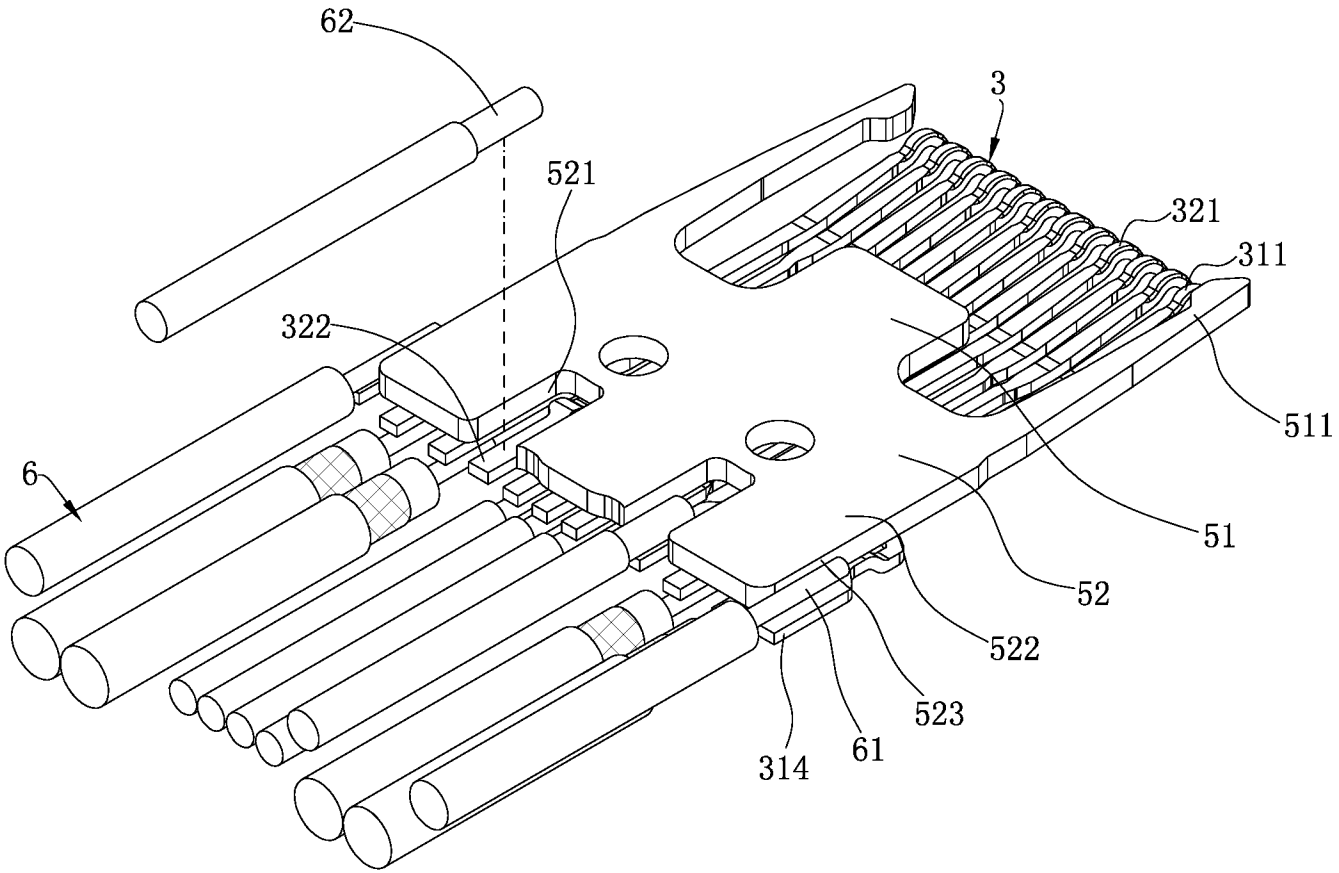
FIG. 3 is a schematic view of the soldering of a second terminal group and a cable according to one embodiment the present invention.

As shown in FIGS. 1, 3 and 5, the front ends of the first terminal group 2 and the second terminal group 3 are located respectively on the upper and lower sides of the insertion cavity 11 in order to be arranged in an upper row and a lower row. Moreover, the first terminal group 2 and the second terminal group 3 are arranged in mutual point symmetry with the central point of the insertion cavity 11 as a center of symmetry, that is, the terminal number of the first terminal group 2 is equal to the terminal number of the second terminal group 3, terminal arrangement sequence is distribution in diagonal symmetry, and thereby the receptacle connector can be plugged normally or reversely. The first terminal group 2 is provided with multiple first signal terminals 23 that are located on the upper surface of the placement platform 16 so as to be soldered to the plurality of signal core wires 63 of the upper row, and the second terminal group 3 is provided with multiple second signal terminals 33 that are located on the lower surface of the placement platform 16 so as to be soldered to the plurality of signal core wires 63 of the lower row. The first terminal group 2 is provided with at least one first ground terminal 21, the second terminal group 3 is provided with at least one second ground terminal 31, the first terminal group 2 is provided with at least one first power terminal 22, and the second terminal group 3 is provided with at least one second power terminal 32. In the present embodiment, the first terminal group 2 and the second terminal group 3 are each provided with twelve terminals and have the same arrangement sequence, both the first terminal group 2 and the second terminal group 3 meet the terminal arrangement sequence of universal serial bus (USB) TYPE C, and the arrangement sequence is as follows: a ground terminal (GND), a high-speed signal terminal pair (SSTXp1 and SSTXn1), a power terminal (Vbus), a detection terminal (CC), a USB2.0 terminal pair (D+ and D−), a reserved terminal (Vconn), a power terminal (Vbus), a high-speed signal terminal pair (SSTXn1 and SSTXp1) and a ground terminal (GND). That is, there are two first ground terminals 21, two second ground terminals 31, two first power terminals 22 and two second power terminals 32. In the other embodiments, the cable connector assembly can also be the specifications of other connectors of the input/output (IO) class, and there can be one or more first ground terminals 21, one or more second ground terminals 31, one or more first power terminals 22 and one or more second power terminals 32. The first terminal group 2 includes multiple first signal terminals 23 that are located between the two first ground terminals 21, that is, the two first ground terminals 21 are located on the outermost sides of the first terminal group 2. The second terminal group 3 is provided with multiple second signal terminals 33 that are located between the two second ground terminals 31, that is, the two second ground terminals 31 are located on the outermost sides of the second terminal group 3. The second ground terminals 31 and the first ground terminals 21 are aligned with each other in the vertical direction, and the second power terminals 32 and the first power terminals 22 are aligned with each other in the vertical direction.

Figure 6:
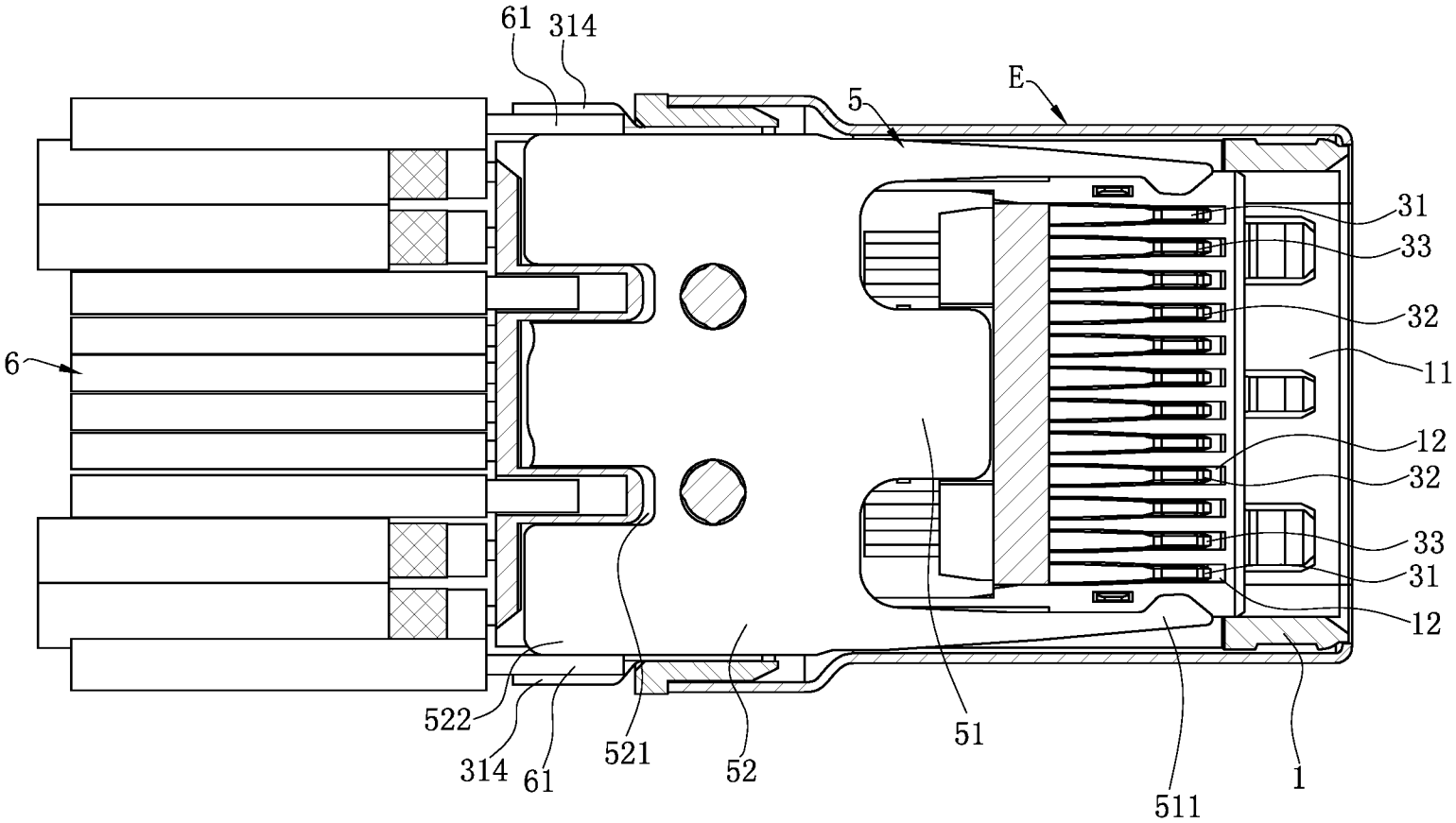
FIG. 6 is a sectional view of FIG. 5 along the A-A direction.

As shown in FIGS. 2, 3 and 6, the cable 6 includes at least one ground core wire 61, at least one power core wire 62 and the two rows of signal core wires 63. In the present embodiment, there are two ground core wires 61, the two ground core wires 61 are located respectively on the two outer sides of the placement platform 16 so as to be soldered correspondingly to the first ground terminals 21 and the second ground terminals 31. There are two power core wires 62, and the power terminals are respectively located correspondingly in the slots 161 in order to be soldered to the power core wires 62. The first signal terminals 23 are located on the upper surface of the placement platform 16 so as to be soldered to the signal core wires 63 of the upper row, the second signal terminals 33 are located on the lower surface of the placement platform 16 so as to be soldered to the plurality of signal core wires 63 of the lower row, and the first ground core wires 61 are located on the outer side of the placement platform 16 so as to be soldered to the first ground terminals 21 and the second ground terminals 31.

Figure 7:
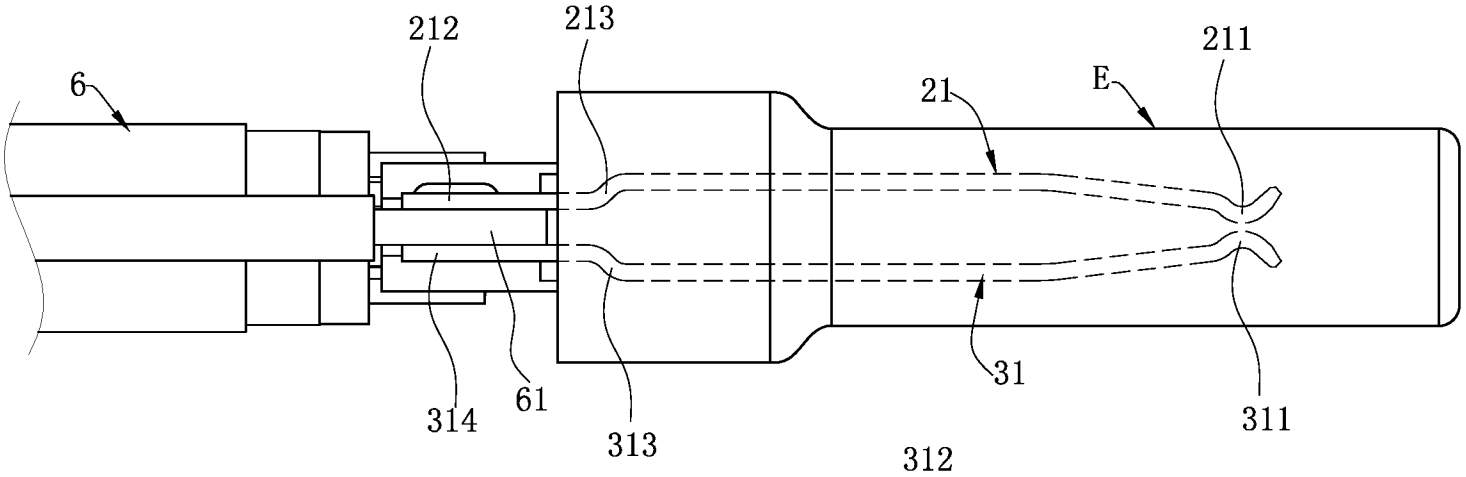
FIG. 7 is a sectional view of FIG. 5 along the B-B direction.

As shown in FIGS. 1, 5 and 7, the front end of each first ground terminal 21 is provided with a first contact portion 211 that forwardly protrudes out of the upper insulating block 14 and passes through the terminal slot 12 to enter the insertion cavity 11, a first deflecting portion 212 is deflected and extends from the first contact portion 211 in a direction away from one side of the first signal terminals 23, a first bending portion 213 is bent downward and extends from the first deflecting portion 212, a first soldering portion 214 is formed by horizontally extending backward from the first bending portion 213 and located on the outer side of the placement platform 16, the front end of each second ground terminal 31 is provided with a second contact portion 311 that forwardly protrudes out of the lower insulating block 15 and passes through the terminal slot 12 to enter the insertion cavity 11, a second deflecting portion 312 is deflected and extends from the second contact portion 311 in a direction away from one side of the second signal terminal 33, a second bending portion 313 is bent upward and extends from the second deflecting portion 312, a second soldering portion 314 is formed by horizontally extending backward from the second bending portion 313 and located on the outer side of the placement platform 16, the second soldering portions 314 and the first soldering portions 214 are arranged oppositely, the second soldering portions 314 and the first soldering portions 214 are aligned with each other in the vertical direction, the ground core wires 61 are located between the second soldering portions 314 and the first soldering portions 214, and are in electrical contact with the second soldering portions 314 and the first soldering portions 214, and in the present embodiment, the second soldering portions 314 and the first soldering portions 214 are soldered directly. The arrangement of the first deflecting portions and the second deflecting portions increases the distance between the first soldering portions 214 and the second soldering portions 314, so that the space for accommodating the signal core wires 63 is enlarged, and thereby the signal core wires 63 can be soldered conveniently to the first signal terminals 23 and the second signal terminals 33. Moreover, since both the first soldering portions 214 and the second soldering portions 314 are located on the outer side of the placement platform 16 so as to be soldered to the ground core wires 61, the space of the placement platform 16 is not occupied, consequently, the space of the placement platform 16 is saved, and the overall volume of the cable connector assembly is reduced. Since the first bending portion 213 is formed by being bent downwardly and extending from the first deflecting portion 212 and the second bending portion 313 is formed by being bent upwardly and extending from the second deflecting portion 312, the distance between the first soldering portions 214 and the second soldering portions 314 is shortened, and thereby the first soldering portions 214 and the second soldering portions 314 can be soldered conveniently to the ground core wires 61.

As shown in FIGS. 1, 3 and 6, one end of each first power terminal 22 is provided with a third contact portion 221, the other end is provided with a third soldering portion 222, and the third soldering portions 222 are located in the slots 161 of the upper surface of the placement platform 16 so as to be soldered to the power core wires 62. One end of each second power terminal 32 is provided with a fourth contact portion 321, the other end is provided with a fourth soldering portion 322, and the fourth soldering portions 322 are located in the slots 161 of the lower surface of the placement platform 16 so as to be soldered to the power core wires 62. The front end of each of the first signal terminals 23 and the second signal terminals 33 is provided with a fifth contact portion (not labeled), the rear end of each of the first signal terminals 23 and the second signal terminals 33 is provided with a fifth soldering portion (not labeled), the fifth soldering portions of the first signal terminals 23 are located on the upper surface of the placement platform 16 in order to be soldered to the signal core wires 63 of the upper row, and the fifth soldering portions of the second signal terminals 33 are located on the lower surface of the placement platform 16 in order to be soldered to the signal core wires 63 of the lower row.

As shown in FIGS. 1, 3 and 6, the shielding sheet 5 is in a shape of a flat plate, and the upper insulating block 14 and the lower insulating block 15 jointly clamp and fix the shielding sheet 5. The front end of the shielding sheet 5 is provided with a base 51 fixed in the insulating body 1, a pair of latch arms 511 respectively extend forward from both sides of the base 51 to enter the insertion cavity 11, and the latch arms 511 are configured to be fastened with a connector receptacle. An extension portion 52 extends backward from the base 51, the extension portion 52 is in a shape of a flat plate, and at least one yield slot 521 is recessed forward from the rear end edge of the extension portion 52. In the present embodiment, two yield slots 521 are arranged to correspond to the two first power terminals 22. In the other embodiments, there can be one or more yield slots 521, as long as the number of the yield slots 521 corresponds to the number of the first power terminals 22. The third soldering portions 222 of the first power terminals 22 extend in over the yield slots 521, the fourth soldering portions 322 of the second power terminals 32 extend in under the yield slots 521, the power core wires 62 are located in the yield slots 521 and are in electrical contact with the third soldering portions 222 and the fourth soldering portions 322. Consequently, since the extension portion 52 is provided with the yield slots 521 at positions corresponding to the third soldering portions 222 and the fourth soldering portions 322, the third soldering portion 222 and the fourth soldering portion 322 can share one core wire, so that the number of the power core wires 62 can be reduced. Moreover, the shielding effect of the shielding sheet 5 on interference signals between the first terminal group 2 and the second terminal group 3 won't be affected. Because the slots 161 and the yield slots 521 are aligned with each other in the vertical direction, the third soldering portions 222 and the fourth soldering portions 322 are located correspondingly in the slots 161 so as to be soldered to the power core wires 62. Because the width of the yield slot 521 is greater than the width of the third soldering portion 222 and the width of the fourth soldering portion 322, not only can the third soldering portions 222 and the fourth soldering portions 322 be soldered conveniently to the power core wires 62, but also an enough distance exists between each of the third soldering portions 222 and the fourth soldering portions 322 and the shielding sheet 5, so that the third soldering portions 222 or the fourth soldering portions 322 can be prevented from touching the shielding sheet 5 to cause short-circuiting. The extension portion 52 is provided with a plate surface 522 and a plate edge 523 perpendicular to the plate surface 522, the ground core wires 61 are soldered to the plate edge 523, and because the plate edge 523 is rougher than the plate surface 522, the ground core wires 61 and the plate edge 523 are soldered more firmly, preventing pseudo soldering.

As shown in FIGS. 4, 5 and 7, the ground core wires 61 are located between the first soldering portions 214 and the second soldering portions 314, and are in electrical contact with the first soldering portions 214, the second soldering portions 314 and the shielding sheet 5, so that the first ground terminal 21, the second ground terminal 31 and the shielding sheet 5 share one core wire. Consequently, the number of the ground core wires 61 is reduced, and thereby, not only is the manufacturing cost reduced, but also the manufacturing process is simplified. In addition, since the shielding sheet 5 is in electrical contact with the ground core wires 61, the phenomenon of poor contact is prevented, and thereby the shielding sheet 5 has a good grounding effect. In the present embodiment, the ground core wires 61 are soldered to the first soldering portions 214, the second soldering portions 314 and the shielding sheet 5. In the other embodiments, the ground core wires 61 can abut against the first soldering portions 214, the second soldering portions 314 and the shielding sheet 5 to form electrical contact. In the present embodiment, the first ground terminals 21 and the second ground terminals 31 are soldered respectively to the upper surfaces and lower surfaces of the ground core wires 61, and the plate edge 523 of the shielding sheet 5 is soldered to the side surfaces of the ground core wires 61. That is, the ground core wires 61 are limited in both the vertical direction and the horizontal direction. Consequently, the ground core wires 61 cannot easily shift, and it is ensured that the ground core wires 61 are soldered more firmly to the first ground terminals 21, the second ground terminals 31 and the shielding sheet 5. A gap H exists between each of the first soldering portions 214 and the second soldering portions 314 and the plate edge 523 in the horizontal direction, and the ground core wires 61 partially extend into the gap so as to be soldered to the plate edge 523, and thereby the soldering process is simplified.

Figure 8:
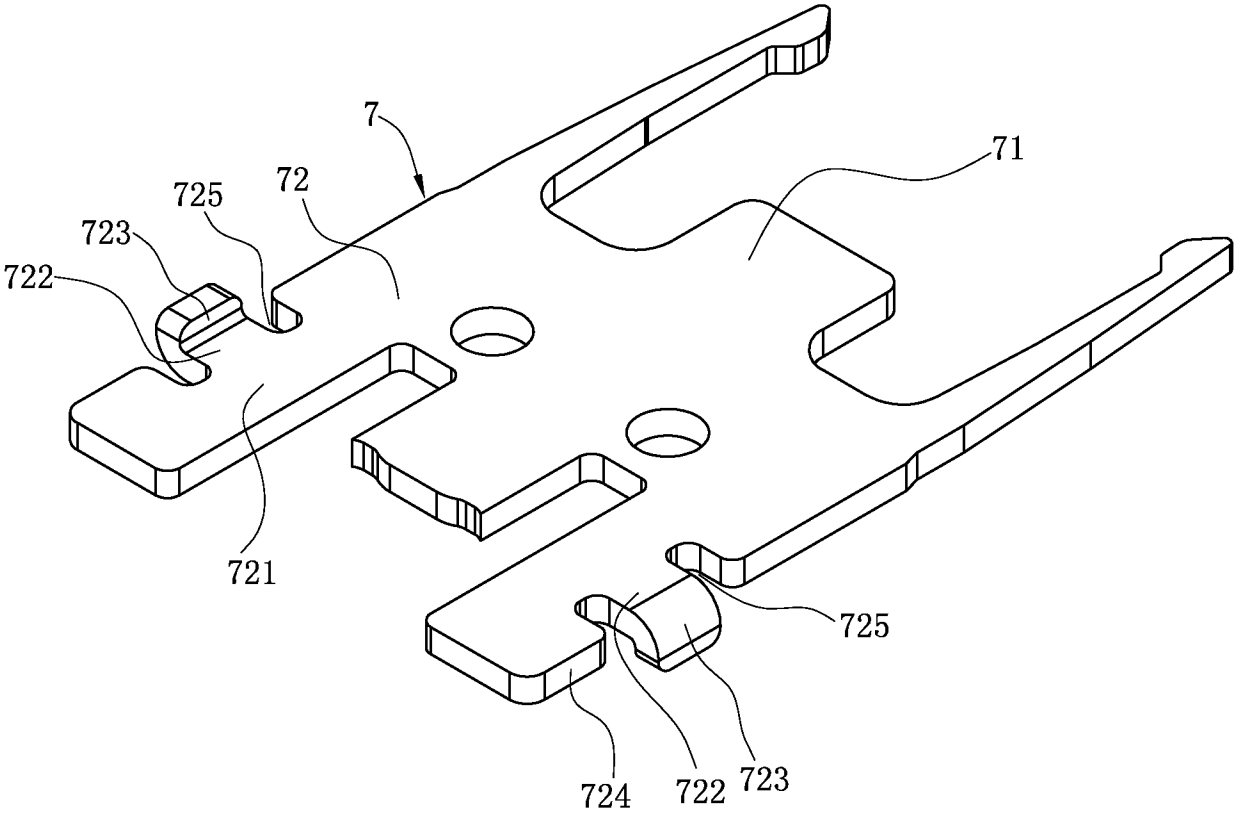
FIG. 8 is a schematic structural view of a shielding sheet of a second embodiment of the present invention.
Figure 9:
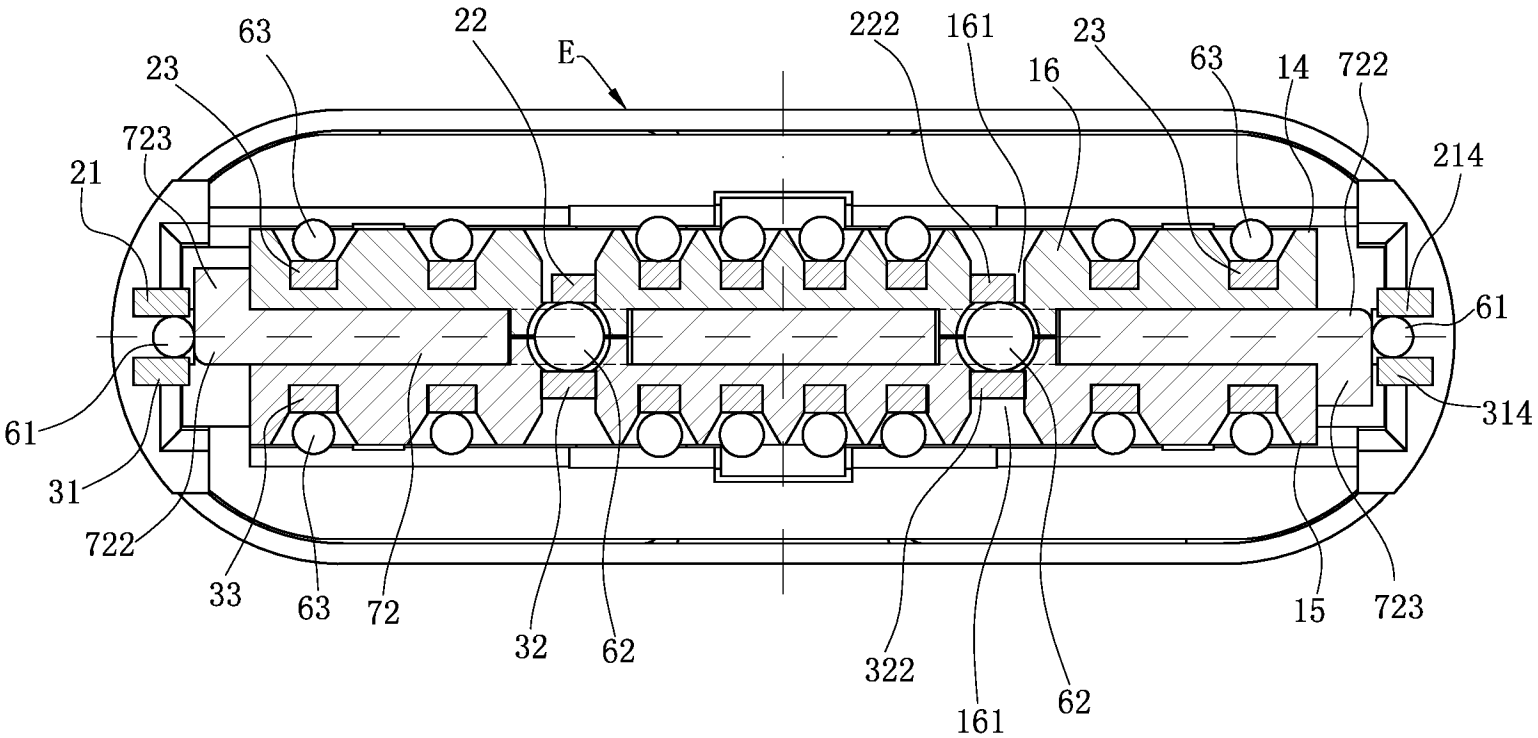
FIG. 9 is a sectional view of a cable connector assembly according to the second embodiment of the present invention.

FIGS. 8 and 9 show a second embodiment of the present invention. The differences from the first embodiment are as follows: the ground core wire 61 is in electrical contact with the plate surface 721 of the shielding sheet 7, but is not in electrical contact with the plate edge 724 of the shielding sheet 7, the shielding sheet 7 is provided with a base 71 located at the front end and an extension portion 72 extending backward from the base 71, a ground portion 723 is bent and extends from at least one side of the plate surface 721 of the extension portion 72 and protrudes out of the insulating body 1, and the ground portion 723 is in electrical contact with the side surface of the ground core wire 61. At least one side of the plate surface 721 is provided with a transversely extending connecting portion 722, the ground portion 723 is formed by being bent and extending from the connecting portion 722 along the vertical direction, the plate edge 724 is recessed transversely with two notches 725 which are respectively located on two opposite sides of the connecting portion 722. The two notches 725 are formed by being respectively recessed transversely from the plate edge 724 on both sides of the connecting portion 722, and the arrangement of the notches 725 makes the ground portion 723 have better elasticity, ensuring that the electrical contact between the ground portion 723 and the ground core wires 61 is firmer. In the present embodiment, the plate surface 721 is provided with two connecting portions 722 and two ground portions 723 which are respectively located on two opposite sides of the plate surface 721. In the other embodiments, only one connecting portion 722 and one ground portion 723 are located on one side of the plate surface 721. The first terminal group 2 is provided with the two first ground terminals 21 on the outermost sides, the second terminal group 3 is provided with the two second ground terminals 31 on the outermost sides, the cable 6 is provided with the two ground core wires 61 which are soldered correspondingly to the two first ground terminals 21 and the two second ground terminals 31, the two ground portions 723 are formed by being bent respectively from both sides of the plate surface 721 and are soldered correspondingly to the side surfaces of the two ground core wires 61, one of the two ground portions 723 is formed by being bent upwardly and extending from one side of the plate surface 721 to block the side of the upper insulating block 14, the other of the two ground portions 723 is formed by being bent downwardly and extending from the other side of the plate surface 721 to block the side of the lower insulating block 15, and thereby the two ground portions 723 can simultaneously fix the upper insulating block 14 and the lower insulating block 15. The ground portions 723 which are formed by being bent and extending from the plate surface 721 of the shielding sheet 7 are in electrical contact with the side surfaces of the ground core wires 61, the phenomenon of poor contact can also be prevented, and thereby the shielding sheet 7 has a good grounding effect.

In summary, the cable connector assembly according to certain embodiments of the present invention has the following beneficial advantages:

(1) The first ground terminal 21 is provided with the first soldering portion 214, the second ground terminal 31 is provided with the second soldering portion 314, the second soldering portion 314 and the first soldering portion 214 are arranged oppositely, the shielding sheet 5 is located between the first terminal group 2 and the second terminal group 3, the cable 6 is provided with the ground core wire 61 which is located between the first soldering portion 214 and the second soldering portion 314 and is in electrical contact with the first soldering portion 214, the second soldering portion 314 and the shielding sheet 5, so that the first ground terminal 21, the second ground terminal 31 and the shielding sheet 5 share one core wire. Consequently, the number of the ground core wires 61 is reduced, and thereby, not only is the manufacturing cost reduced, but also the manufacturing process is simplified. In addition, since the shielding sheet 5 is in electrical contact with the ground core wire 61, the phenomenon of poor contact is prevented, and thereby the shielding sheet 5 has a good grounding effect.

(2) The arrangement of the first deflecting portions and the second deflecting portions increases the distance between the first soldering portions 214 and the second soldering portions 314, so that the space for accommodating the signal core wires 63 is enlarged, and thereby the signal core wires 63 can be soldered conveniently to the first signal terminals 23 and the second signal terminals 33. Moreover, since both the first soldering portions 214 and the second soldering portions 314 are located on the outer side of the placement platform 16, the space of the placement platform 16 is not occupied, consequently, the space of the placement platform 16 is saved, and the overall volume of the cable connector assembly is reduced.

(3) Since the extension portion 52 is provided with the yield slots 521 at positions corresponding to the third soldering portions 222 and the fourth soldering portions 322, the third soldering portion 222 and the fourth soldering portion 322 can share one core wire. Consequently, the number of the power core wires 62 can be reduced, and moreover, the shielding effect of the shielding sheet 5 on interference signals between the first terminal group 2 and the second terminal group 3 won't be affected.

(4) Because the width of the yield slot 521 is greater than the width of the third soldering portion 222 and the width of the fourth soldering portion 322, not only can the third soldering portions 222 and the fourth soldering portions 322 be soldered conveniently to the power core wires 62, but also an enough distance exists between each of the third soldering portions 222 and the fourth soldering portions 322 and the shielding sheet 5, so that the third soldering portions 222 or the fourth soldering portions 322 can be prevented from touching the shielding sheet 5 to cause short-circuiting.

(5) The ground core wires 61 are soldered to the plate edge 523, and because the plate edge 523 is rougher than the plate surface 522, the ground core wires 61 and the plate edge 523 are soldered more firmly, preventing pseudo soldering.

(6) In the present embodiment, the first ground terminals 21 and the second ground terminals 31 are soldered respectively to the upper surfaces and lower surfaces of the ground core wires 61, the plate edge 523 of the shielding sheet 5 is soldered to the side surfaces of the ground core wires 61, that is, the ground core wires 61 are limited in both the vertical direction and the horizontal direction, consequently, the ground core wires 61 cannot easily shift, and it is ensured that the ground core wires 61 are soldered more firmly to the first ground terminals 21, the second ground terminals 31 and the shielding sheet 5.

(7) The two ground portions 723 are formed by being bent respectively from both sides of the plate surface 721 and are soldered correspondingly to the side surfaces of the two ground core wires 61, one of the two ground portions 723 is formed by being bent upwardly and extending from one side of the plate surface 721 to block the side of the upper insulating block 14, the other of the two ground portions 723 is formed by being bent downwardly and extending from the other side of the plate surface 721 to block the side of the lower insulating block 15, and thereby the two ground portions 723 can simultaneously fix the upper insulating block 14 and the lower insulating block 15.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A cable connector assembly, comprising:

an insulating body;

a first terminal group and a second terminal group received in the insulating body and respectively arranged into an upper row and a lower row, wherein the first terminal group comprises at least one first ground terminal, the at least one first ground terminal has a first soldering portion, the second terminal group comprises at least one second ground terminal, the at least one second ground terminal has a second soldering portion, and the second soldering portion and the first soldering portion are arranged oppositely;

a shielding sheet, fixed in the insulating body and located between the first terminal group and the second terminal group; and a cable comprising at least one ground core wire, wherein the at least one ground core wire is located between the first soldering portion and the second soldering portion and is in electrical contact with the first soldering portion, the second soldering portion and the shielding sheet.

2. The cable connector assembly of claim 1, wherein the shielding sheet is provided with a plate surface and a plate edge perpendicular to the plate surface, and the ground core wire is soldered to the plate edge.

3. The cable connector assembly of claim 2, wherein the at least one second ground terminal and the at least one first ground terminal are aligned with each other in a vertical direction, the at least one second ground terminal and the at least one first ground terminal are respectively soldered to an upper surface and a lower surface of the ground core wire, and the plate edge of the shielding sheet is soldered to a side surface of the ground core wire.

4. The cable connector assembly of claim 2, wherein a gap exists between each of the first soldering portion and the second soldering portion and the plate edge in a horizontal direction, and the ground core wire partially extends into the gap so as to be soldered to the plate edge.

5. The cable connector assembly of claim 1, wherein the shielding sheet is provided with a base fixed in the insulating body, an extension portion extends backward from the base, at least one yield slot is recessed forward from a rear end edge of the extension portion, the first terminal group is provided with at least one first power terminal, a third soldering portion extends from the first power terminal to enter and over the yield slot, the second terminal group is provided with at least one second power terminal, a fourth soldering portion extends from the second power terminal to enter and under the yield slot, the cable is provided with at least one power core wire, and the power core wire is located in the yield slot and is in electrical contact with the third soldering portion and the fourth soldering portion.

6. The cable connector assembly of claim 5, wherein a width of the yield slot is greater than a width of the third soldering portion and a width of the fourth soldering portion.

7. The cable connector assembly of claim 5, wherein the first terminal group and an upper insulating block are insert-molded as a whole, the second terminal group and a lower insulating block are insert-molded as a whole, a rear end of the insulating body is recessed forward with a receiving cavity, the upper insulating block and the lower insulating block jointly clamp the shielding sheet and are mounted in the receiving cavity, a placement platform which protrudes out of a rear end of the receiving cavity is formed, the cable comprises two rows of signal core wires which are arranged respectively on an upper surface and a lower surface of the placement platform, the first terminal group comprises a plurality of first signal terminals located on the upper surface of the placement platform so as to be soldered to the plurality of signal core wires of the upper row, the second terminal group comprises a plurality of second signal terminals located on the lower surface of the placement platform so as to be soldered to the plurality of signal core wires of the lower row, and the first ground core wire is located on outer side of the placement platform so as to be soldered to the first ground terminal and the second ground terminal.

8. The cable connector assembly of claim 7, wherein a front end of the first ground terminal is provided with a first contact portion that protrudes forward out of the upper insulating block, a first deflecting portion is deflected and extends from the first contact portion in a direction away from one side of the first signal terminals, a first bending portion is bent downward and extends from the first deflecting portion, and the first soldering portion is formed by horizontally extending backward from the first bending portion and located outside of the placement platform.

9. The cable connector assembly of claim 7, wherein the upper surface and lower surface of the placement platform are respectively provided with at least one slot corresponding to the yield slot, and the third soldering portion and the fourth soldering portion are located correspondingly in the slots so as to be soldered to the power core wire.

10. The cable connector assembly of claim 5, wherein a front end of the insulating body is recessed backward with an insertion cavity, a pair of latch arms respectively extends forward from both sides of the base to enter the insertion cavity, a plurality of terminal slots are respectively recessed from a top surface and a bottom surface of the insulating body, the terminal slots communicate with the insertion cavity, the first terminal group and the second terminal group are received in the insertion cavity and extend respectively into the terminal slots of the top surface and bottom surface of the insulating body, the first terminal group is provided with two first ground terminals on outermost sides, and the second terminal group is provided with two second ground terminals on outermost sides.

11. The cable connector assembly of claim 10, wherein each of the first terminal group and the second terminal group is provided with twelve terminals, and the first terminal group and the second terminal group are arranged in mutual point symmetry with a central point of the insertion cavity as a center of symmetry.

12. The cable connector assembly of claim 1, wherein the shielding sheet is provided with a plate surface having a flat plate shape and a plate edge perpendicular to the plate surface, at least one ground portion is bent and extends from the plate surface to protrude out of the insulating body, and the at least one ground portion is in electrical contact with a side surface of the ground core wire.

13. The cable connector assembly of claim 12, wherein the plate surface is provided with at least one connecting portion which extends transversely, the ground portion is formed by being bent and extending from the connecting portion along the vertical direction, and the plate edge is recessed transversely with two notches which are respectively located on two opposite sides of the connecting portion.

14. The cable connector assembly of claim 12, wherein the first terminal group is provided with two first ground terminals on outermost sides, the second terminal group is provided with two second ground terminals on outermost sides, the cable is provided with two ground core wires which are soldered correspondingly to the two first ground terminals and the two second ground terminals, and two ground portions are formed by being bent respectively from both sides of the plate surface so as to be soldered correspondingly to the side surfaces of the two ground core wires.

15. The cable connector assembly of claim 12, wherein the first terminal group and an upper insulating block are insert-molded as a whole, the second terminal group and a lower insulating block are insert-molded as a whole, a rear end of the insulating body is recessed forward with a receiving cavity, the upper insulating block and the lower insulating block jointly clamp the shielding sheet and are mounted in the receiving cavity, the plate surface is provided with two ground portions, one of the ground portions is formed by being bent upwardly and extending from one side of the plate surface to block a side of the upper insulating block, and the other of the ground portions is formed by being bent downwardly and extending from the other side of the plate surface to block a side of the lower insulating block.

16. The cable connector assembly of claim 5, wherein the extension portion is provided with a plate surface and a plate edge perpendicular to the plate surface, the plate edge is rougher than the plate surface, and the ground core wire is soldered to the plate edge.

* * * * *